US008037859B2

(12) United States Patent
Kameda

(10) Patent No.: US 8,037,859 B2
(45) Date of Patent: Oct. 18, 2011

(54) INTAKE MANIFOLD

(75) Inventor: Yasutoshi Kameda, Toyota (JP)

(73) Assignee: Denso Corporation, Kariya (JP)

( * ) Notice: Subject to any disclaimer, the term of this patent is extended or adjusted under 35 U.S.C. 154(b) by 443 days.

(21) Appl. No.: 12/407,166

(22) Filed: Mar. 19, 2009

(65) Prior Publication Data

US 2009/0241886 A1 Oct. 1, 2009

(30) Foreign Application Priority Data

Mar. 27, 2008 (JP) ..... 2008-083561

(51) Int. Cl.
*F02M 35/10* (2006.01)

(52) U.S. Cl. ..... 123/184.38; 123/184.21

(58) Field of Classification Search ..... 123/184.21, 123/184.38–184.46, 184.61
See application file for complete search history.

(56) References Cited

U.S. PATENT DOCUMENTS 5,630,387 A * 5/1997 Kamiyama ..... 123/184.38
7,270,102 B2 * 9/2007 Tanikawa et al. ..... 123/184.42
2010/0162984 A1 * 7/2010 Wakamatsu et al. ..... 123/184.21

FOREIGN PATENT DOCUMENTS

JP 2003-322059 11/2003

* cited by examiner

*Primary Examiner* — Michael Cuff
*Assistant Examiner* — Irvin Marrero
(74) *Attorney, Agent, or Firm* — Nixon & Vanderhye PC

(57) ABSTRACT

An intake manifold to be mounted to a traverse engine includes pieces made of resin and welded to each other. The pieces are constructed with a first piece having a connector to be connected to the engine, and a second piece. The second piece has an upper positioning part overlapping with the first piece except for the connector having a linear-shaped outlet passage. The upper positioning part is welded to the first piece so as to define an upstream side passage of the outlet passage. The first piece has a cover, which covers the upper positioning part defining a downstream end of the upstream side passage.

4 Claims, 9 Drawing Sheets

INTAKE MANIFOLD

CROSS REFERENCE TO RELATED APPLICATION

This application is based on Japanese Patent Application No. 2008-083561 filed on Mar. 27, 2008, the disclosure of which is incorporated herein by reference in its entirety.

BACKGROUND OF THE INVENTION

1. Field of the Invention

The present invention relates to an intake manifold.

2. Description of Related Art

An intake manifold is typically produced by integrating resin-molded pieces. For example, an ultrasonic vibration welding is used for the integrating. FIGS. 5, 6A, 6B, 7, and 8 show an intake manifold 100 for sending intake air into a four-cylindered engine 110. The intake manifold 100 is produced by welding four pieces 101.

Here, a traverse engine is traversely mounted on a front engine front drive (FF) type automobile such that cylinders of the engine are arranged in a width direction of the automobile. In the traverse engine, the intake manifold 100 is disposed such that intake ports 102 communicating with the cylinders are also arranged in the width direction of the automobile.

As shown in FIG. 8, a fuel system having an injector 103 and a fuel rail 104 is located above the intake manifold 100. The injector 103 injects fuel, and the fuel rail 104 distributes fuel into the injector 103. If the intake manifold 100 is broken due to a large impact to the automobile, a part of broken intake manifold may contact the fuel system. In this case, the fuel system may be damaged.

JP-A-2003-322059 discloses an intake manifold 100 shown in FIG. 9, in which a welded part 105 of the intake manifold 100 is located above a fuel system. The welded part 105 is the most breakable part of the intake manifold 100.

As shown in FIG. 9, the intake manifold 100 includes a connector 106 to be connected to an engine. Further, a first piece 101*a* welded to a second piece 101*b* is improved such that the welded part 105 defined between the first piece 101*a* and the second piece 101*b* is located above the fuel system. That is, the connector 106 of the first piece 101*a* is made to have a linear shape, to be relatively long, and to be inclined downward. Thus, the welded part 105 is located above the fuel system.

However, the connector 106 may not be able to be long or inclined, based on mounting conditions of a variety of devices in an engine compartment. In this case, the welded part 105 may be required to be located under the fuel system. Further, the fuel system is required to be protected from a broken piece of the welded part 105, if the welded part 105 is broken.

SUMMARY OF THE INVENTION

In view of the foregoing and other problems, it is an object of the present invention to provide an intake manifold.

According to a first example of the present invention, an intake manifold is to be mounted to a traverse engine in which cylinders of the engine are arranged in a width direction of an automobile. The intake manifold includes a plurality of pieces, which is made of resin and welded to each other so as to be traversely long in the width direction. The plurality of pieces includes a first piece having a connector to be connected to the engine, and a second piece welded to the first piece. The second piece is welded to the connector of the first piece, and has an upper positioning part, which overlaps with the first piece except for the connector from an upper side, so as to be welded to the first piece. The connector has a linear-shaped outlet passage. The upper positioning part is welded to the first piece so as to define an upstream side passage of the outlet passage. The first piece has a cover, which covers the upper positioning part defining a downstream end of the upstream side passage from an upper side.

Accordingly, if the intake manifold is broken due to a large impact applied to the automobile, the cover prevents the second piece from moving upward, such that the possibility that a broken part of the intake manifold damages a fuel system can be reduced.

According to a second example of the present invention, an intake manifold is to be mounted to a traverse engine in which cylinders of the engine are arranged in a width direction of an automobile. The intake manifold includes a first piece having a connector defining a linear-shaped outlet passage, which is to be connected to the engine, and a second piece having an upper positioning part, which overlaps with the first piece except for the connector from an upper side. The upper positioning part of the second piece is welded to the first piece, so as to define an upstream side passage of the outlet passage. The first piece has a cover covering the upper positioning part from an upper side, such that the covered upper positioning part defines a downstream end of the upstream side passage of the outlet passage.

Accordingly, if the intake manifold is broken due to a large impact applied to the automobile, the cover prevents the second piece from moving upward, such that the possibility that a broken part of the intake manifold damages a fuel system can be reduced.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

An intake manifold 1 of an embodiment will be described with reference to FIGS. 1, 2A, 2B, 3, and 4. The intake manifold 1 supplies intake air to a four-cylindered engine 30, which is traversely mounted in an engine compartment of a front engine front drive (FF) type automobile. The engine 30 is arranged in the engine compartment such that cylinders of the engine 30 are arranged in a width direction of the automobile. An engine is typically arranged in this traverse direction in an FF type automobile.

Figure 4:
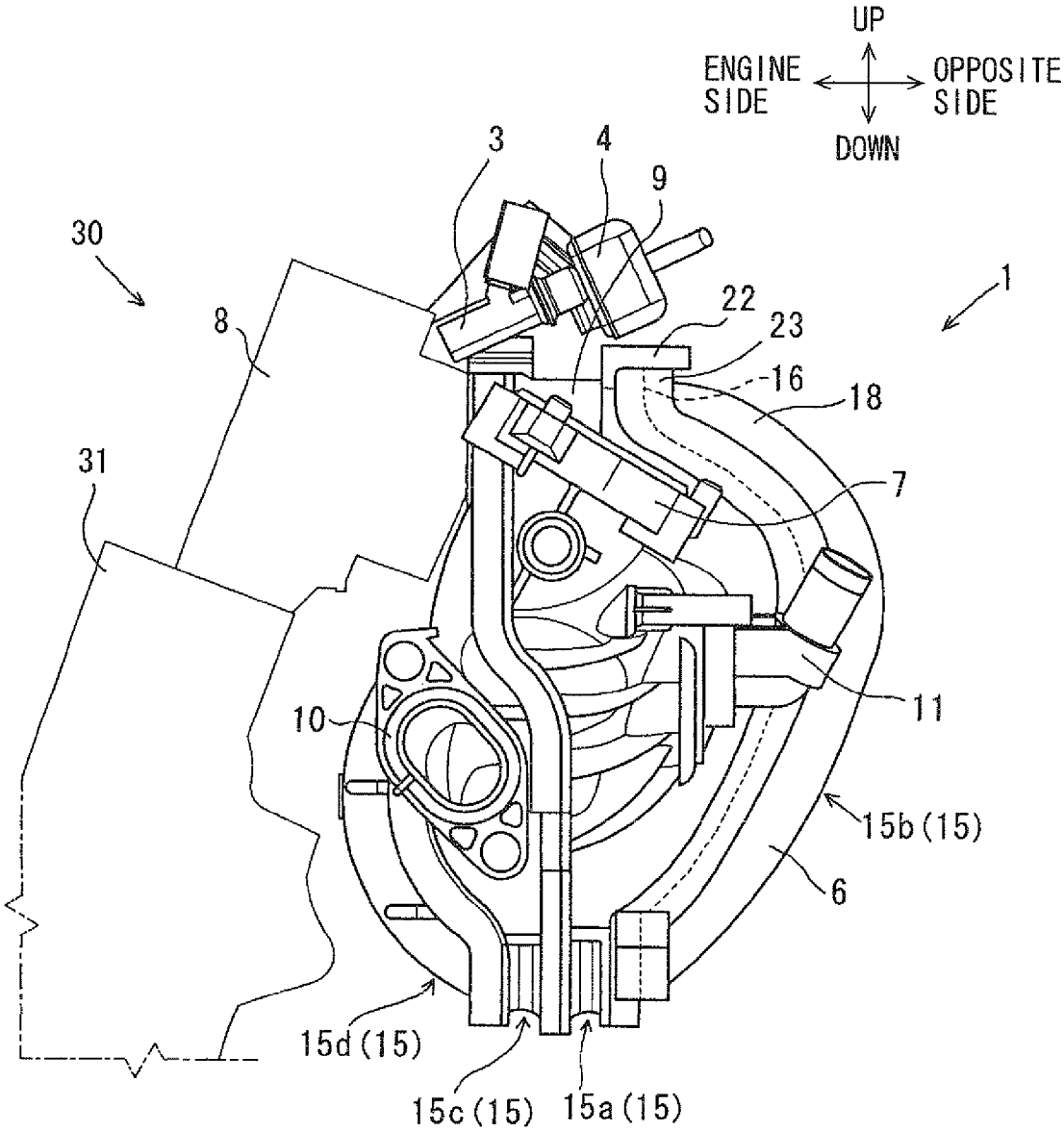
FIG. 4 is a side view showing the intake manifold.
Figure 5:
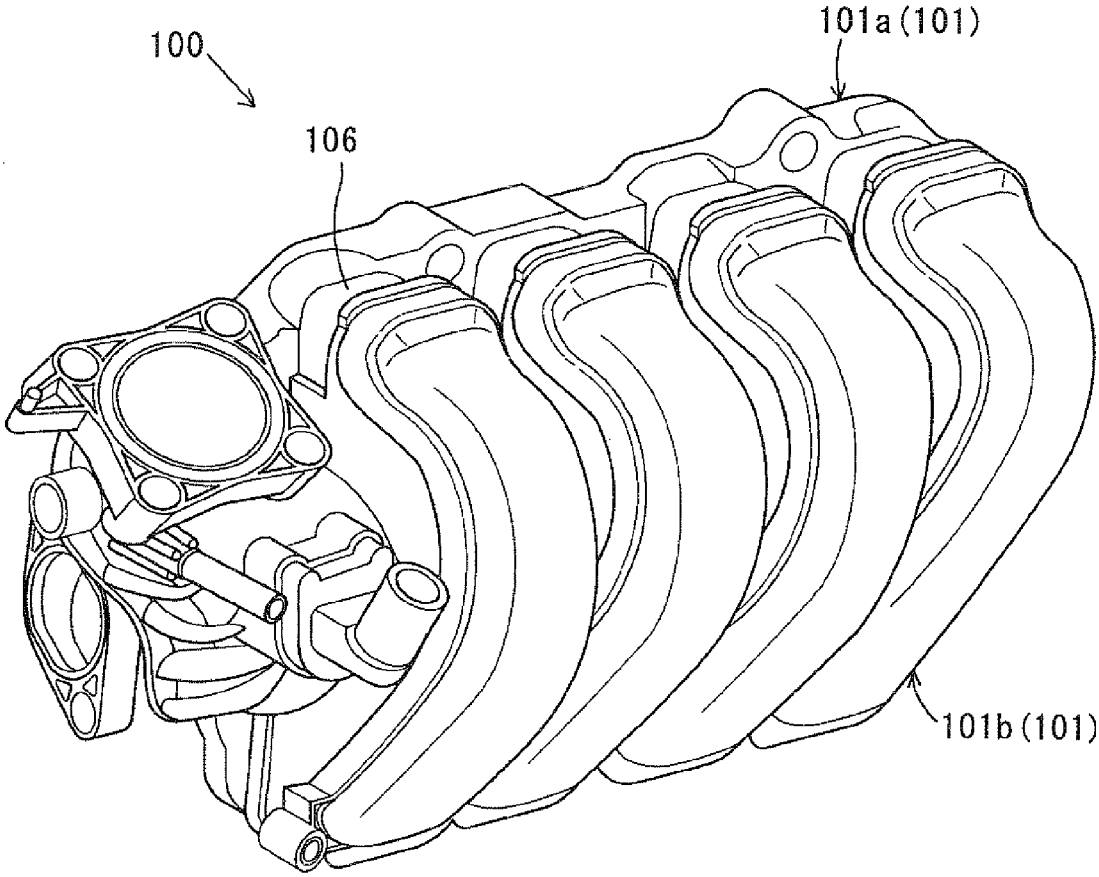
FIG. 5 PRIOR ART
FIG. 5 is a perspective view showing a conventional intake manifold.
Figure 6A:
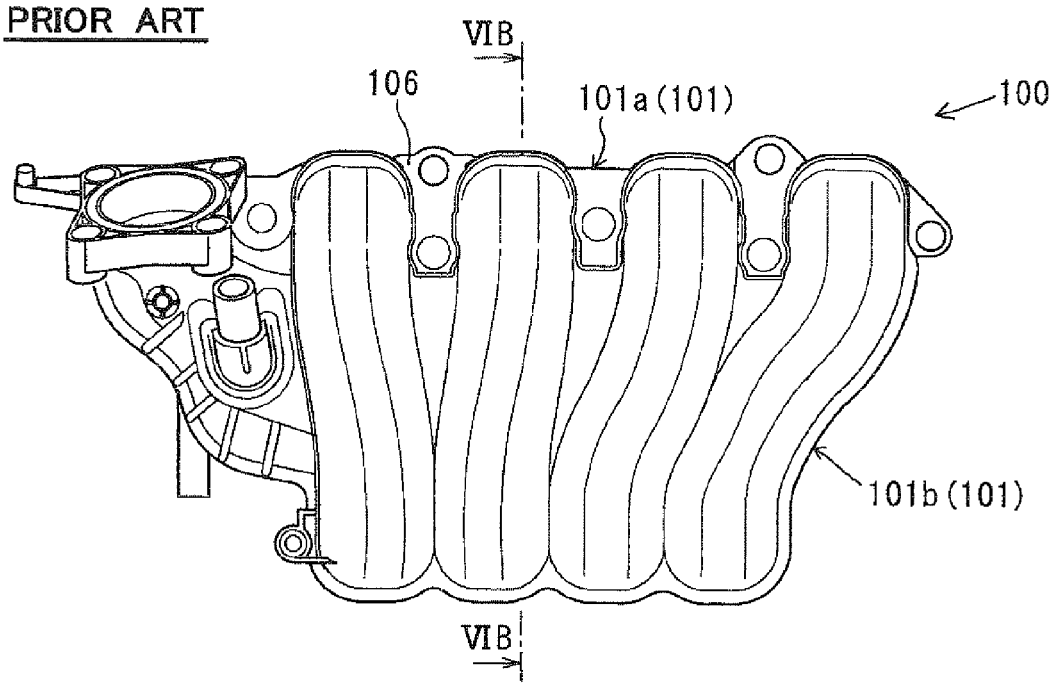
FIG. 6A PRIOR ART
FIG. 6A is an elevation view showing the conventional intake manifold.
Figure 6B:
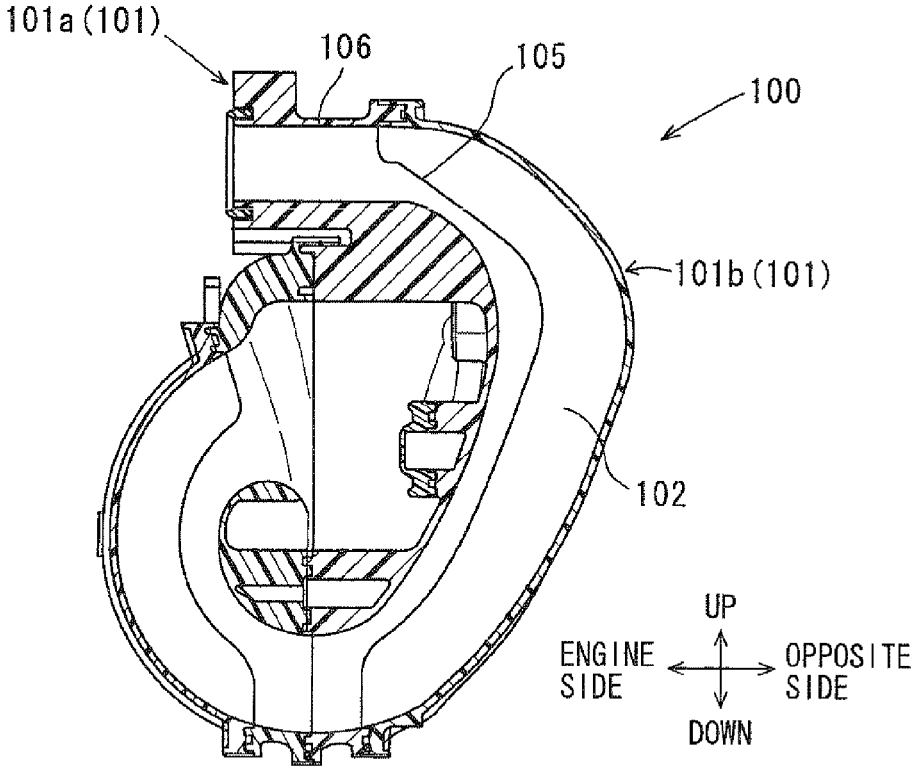
FIG. 6B PRIOR ART
FIG. 6B is a cross-sectional view taken along line VIB-VIB in FIG. 6A.
Figure 7:
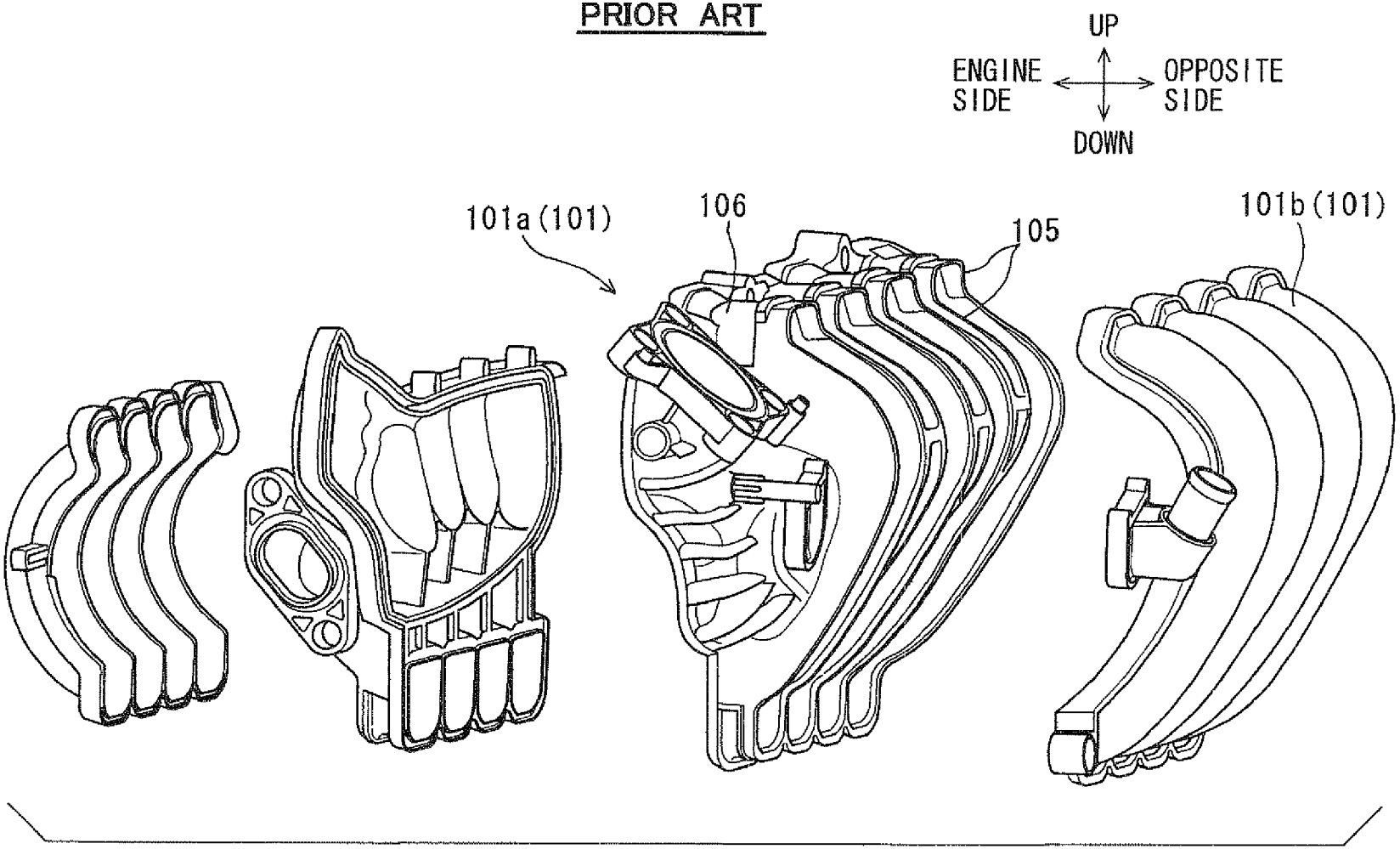
FIG. 7 PRIOR ART
FIG. 7 is an exploded perspective view showing the conventional intake manifold.
Figure 8:
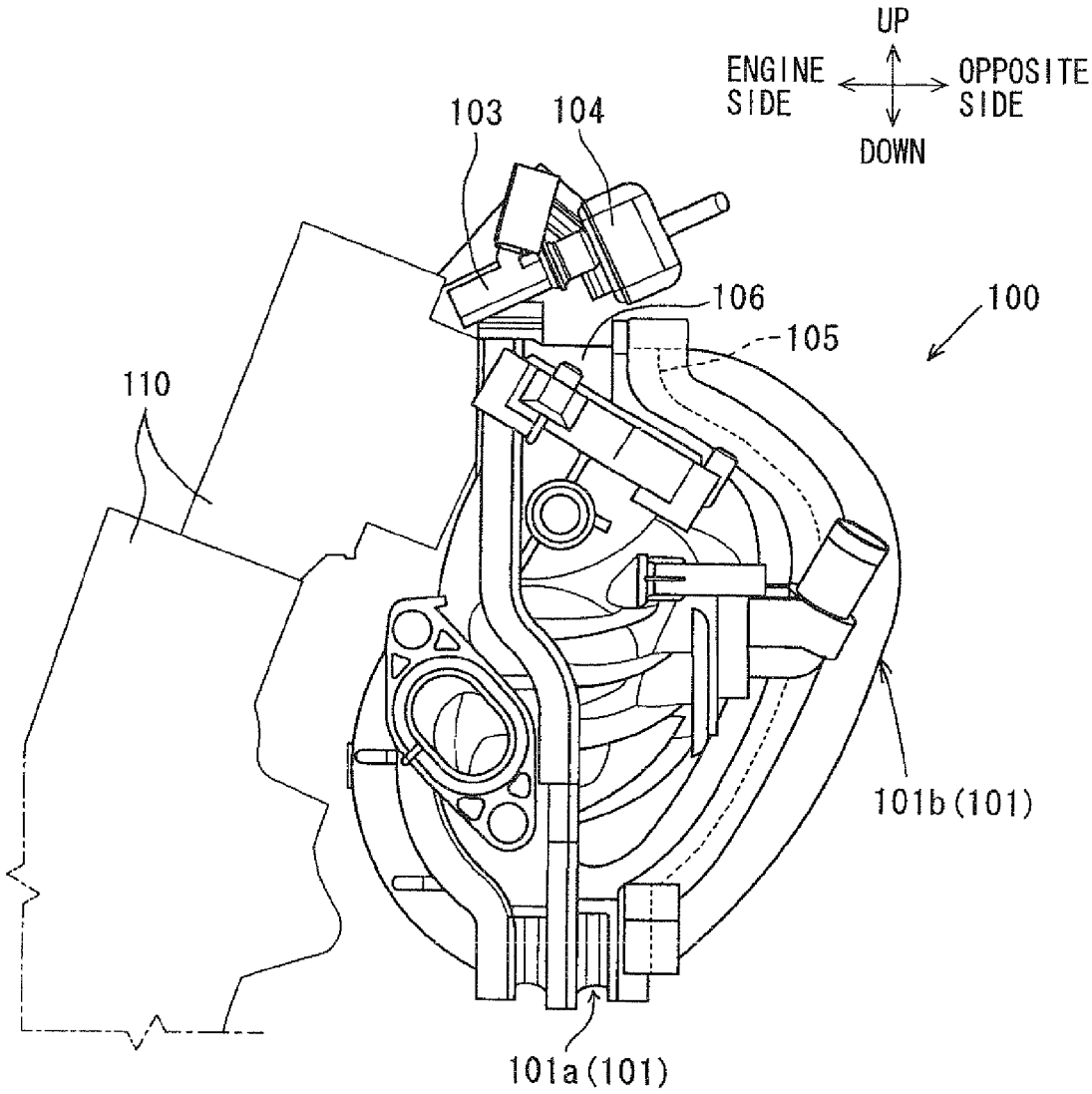
FIG. 8 PRIOR ART
FIG. 8 is a side view showing the conventional intake manifold.
Figure 9:
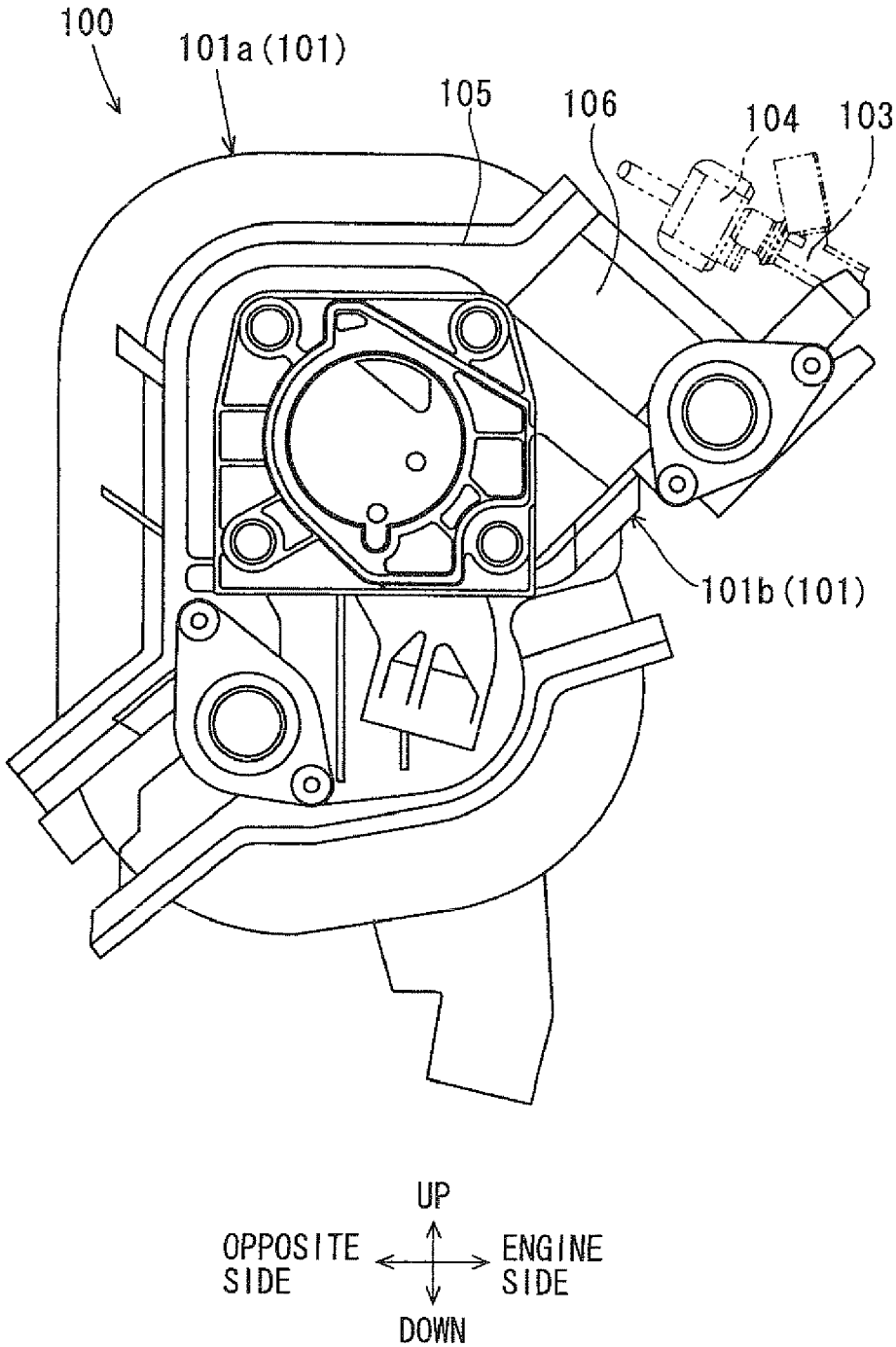
FIG. 9 PRIOR ART
FIG. 9 is a side view showing another conventional intake manifold.

The intake manifold 1 is mounted to the engine 30 such that intake ports 2 communicating with the cylinders are arranged in the width direction of the automobile. As shown in FIG. 4, a fuel system having an injector 3 and a fuel rail 4 is located above the intake manifold 1. The injector 3 injects fuel toward intake air, and the fuel rail 4 distributes fuel into the injector 3.

The intake manifold 1 includes a casing 67 an upstream side connector 7, an engine connector 9, an exhaust gas recirculation (EGR) connector 10, a positive crankcase ventilation (PCV) connector 11, and so on. The intake port 2 is defined in the casing 6. The upstream side connector 7 is connected to a device or pipe located at an upstream side of the intake manifold 1. For example, the upstream side connector 7 is connected to a throttle device. The engine connector 9 is connected to an engine head 8 of the engine 30. The engine head 8 is connected to an engine block 31 of the engine 30. The EGR connector 10 is used for recirculating a part of EGR gas into intake air. The PCV connector 11 is used for introducing PCV gas discharged from a crankcase of the engine 30. Further, the casing 6 has the intake port 2 communicating with a cylinder, a surge tank 12, and so on. The surge tank 12 receives intake air from the upstream side connector 7, and supplies the intake air to the intake port 2.

Figure 3:
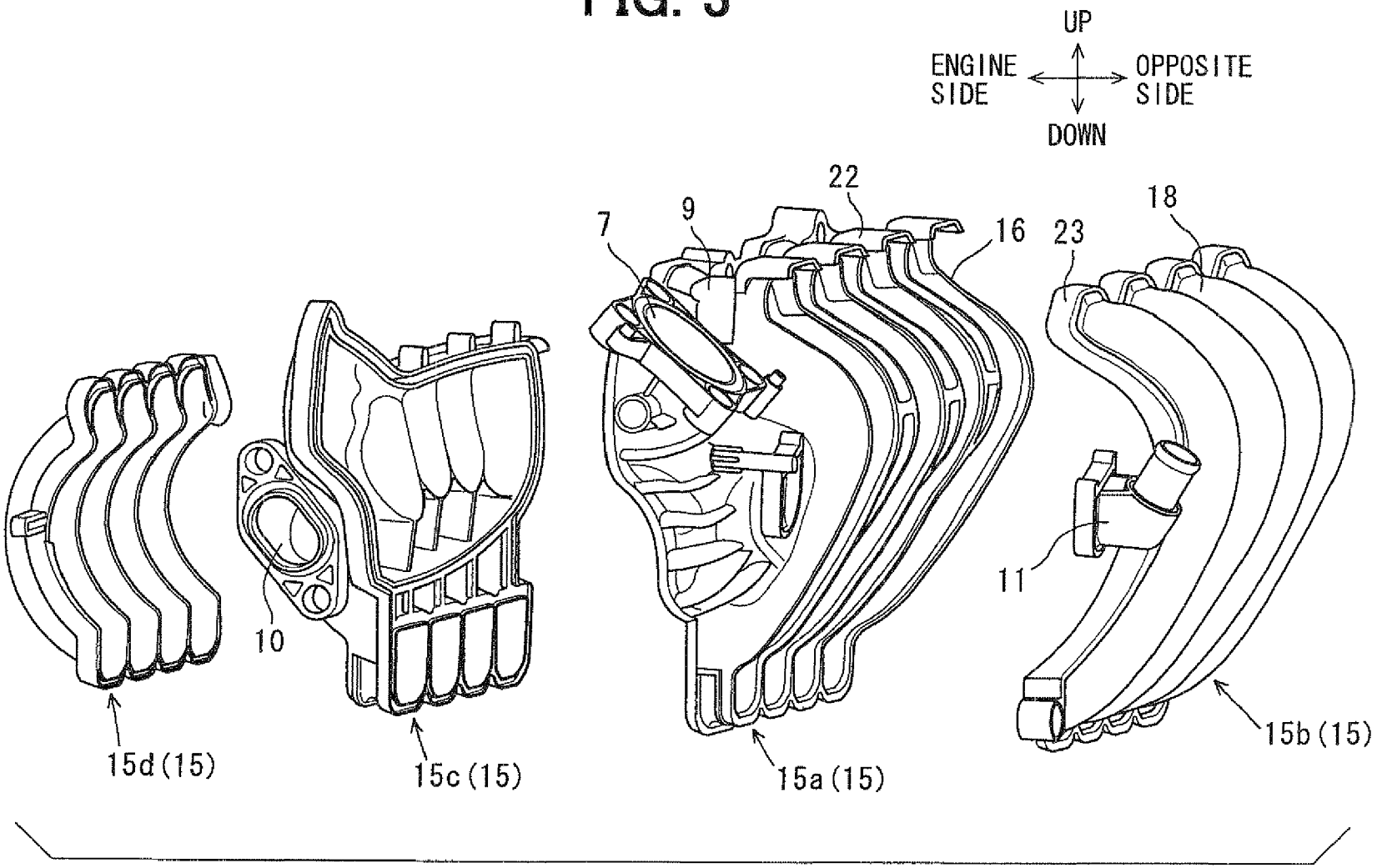
FIG. 3 is an exploded perspective view showing the intake manifold.

Further, as shown in FIG. 3, the intake manifold 1 is produced by integrating four resin-molded pieces 15 for example. An ultrasonic vibration welding is used for the integrating, for example. That is, the pieces 15 are welded to each other through a welded part 16. A bead weld is applied to one of the pieces 15, and the applied bead weld is melted by vibration, such that the pieces 15 are welded to each other.

The four pieces 15 are constructed with a first piece 15*a*, a second piece 15*b*, a third piece 15*c*, and a fourth piece 15*d*, as shown in FIG. 3. The first piece 15*a* has the upstream side connector 7 and the engine connector 9. The second piece 15*b* has the PCV connector 11, and is welded to the first piece 15*a* from an opposite side opposite to an engine side. A downstream part of the intake port 2 is constructed with the first piece 15*a* and the second piece 15*b*. The third piece 15*c* has the EGR connector 10, and is welded to the first piece 15*a* from the engine side. The surge tank 12 is constructed with the first piece 15*a* and the third piece 15*c*. The fourth piece 15*d* is welded to the third piece 15*c* from the engine side. An upstream part of the intake port 2 is constructed with the third piece 15*c* and the fourth piece 15*d*.

Figure 1:
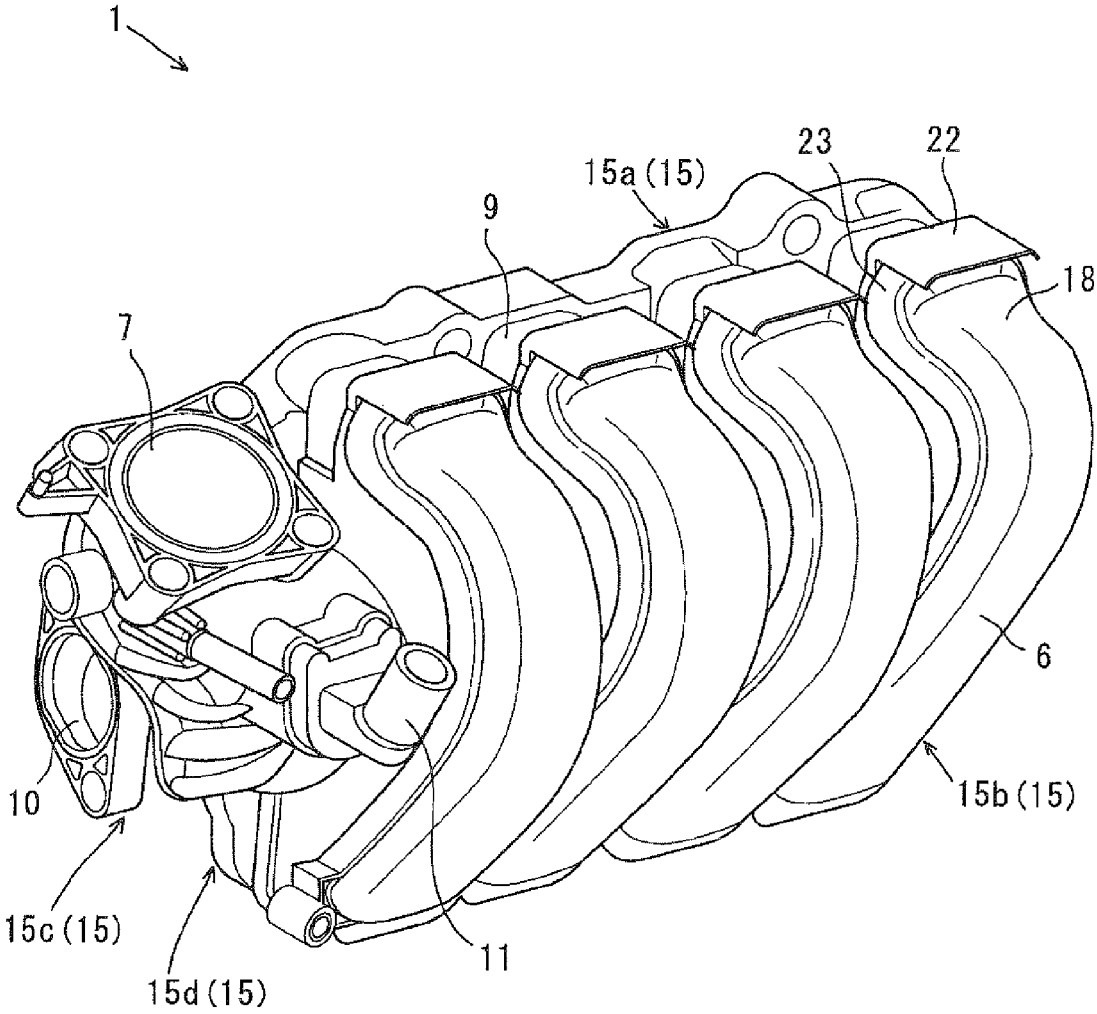
FIG. 1 is a perspective view showing an intake manifold according to an embodiment of the present invention.
Figure 2A:
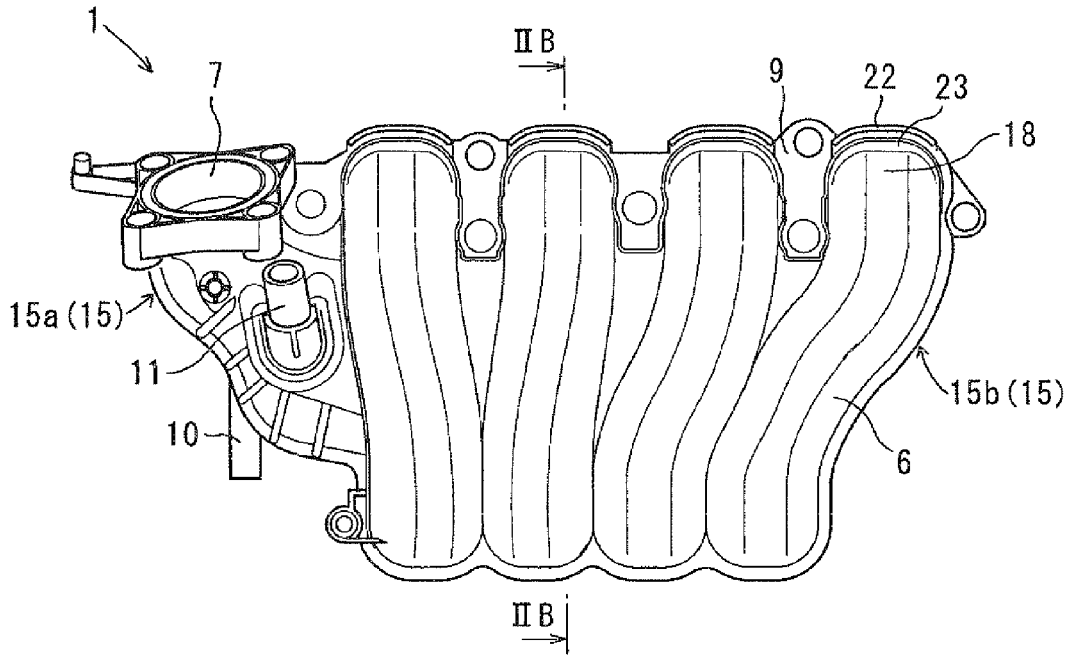
FIG. 2A is an elevation view showing the intake manifold.
Figure 2B:
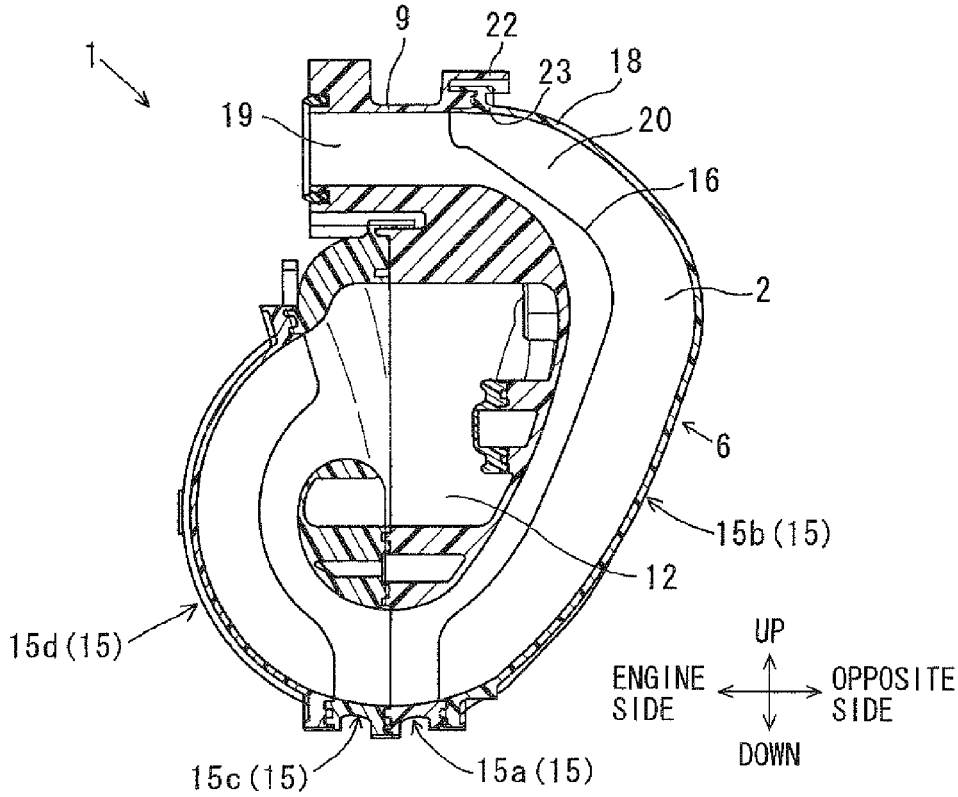
FIG. 2B is a cross-sectional view taken along line IIB-IIB in FIG. 2A.

Further, the second piece 15*b* includes an upper positioning part 18, which is welded to the engine connector 9. The upper positioning part 18 overlaps with the first piece 15*a* except for the engine connector 9 from an upper side, so as to be welded to the first piece 15*a*. Here, as shown in FIG. 2B, the engine connector 9 has four linear-shaped outlet passages 19 communicating with an intake passage of the engine 30. The upper positioning part 18 is welded to the first piece 15*a*, such that four upstream side passages 20 are defined at an upstream side of the outlet passages 19. The four outlet passages 19 and the four upstream side passages 20 are a part of the downstream part of the intake port 2.

Further, the first piece 15*a* has four covers 22. The cover 22 partially covers the upper positioning part 18. The cover 22 is disposed on a top side of an upstream end of the engine connector 9 defining an upstream end of the outlet passage 19. The cover 22 extends toward the opposite side opposite to the engine side. When the first and second pieces 15*a*, 15*b* are welded to each other, the cover 22 is disposed on a top side of a downstream end 23 of the upper positioning part 18 defining a downstream end of the upstream side passage 20. That is, when the first and second pieces 15*a*, 15*b* are welded to each other, the cover 22 is arranged to cover the downstream end 23 from an upper side.

According to the embodiment, the intake manifold 1 is mounted to a traverse-mounted type engine, and produced by welding the four pieces 15. The intake manifold 1 is traversely long in the width direction of the automobile. Further, the four pieces 15 includes the first piece 15*a*, and the second piece 15*b* welded to the first piece 15*a* from the opposite side opposite to the engine side. Furthermore, the engine connector 9 has the linear-shaped outlet passage 19. The upper positioning part 18 of the second piece 15*b* is welded to the first piece 15*a* such that the upstream side passage 20 is defined at an upstream side of the outlet passage 19. The first piece 15*a* has the cover 22 covering the downstream end 23 of the upper positioning part 18 from an upper side.

Thereby, if the first and second pieces 15*a*, 15*b* are separated from each other due to a breaking of the welded part 16 between the first and second pieces 15*a*, 15*b*, the cover 22 prevents the second piece 15*b* from moving upward. Therefore, the fuel system has less possibility to be damaged, because the second piece 15*b* is not moved toward the fuel system.

If the intake manifold 1 is broken due to a large impact applied to the automobile, the welded part 16 is the most breakable in the intake manifold 1. Even if the second piece 15*b* becomes movable upward due to the breaking of the welded part 16, the cover 22 prevents the second piece 15*b* from moving upward. The possibility that a broken part of the intake manifold 1 damages the fuel system can be reduced, even if an impact is applied to the automobile.

The intake manifold 1 is mounted to the four-cylindered engine. Alternatively, the intake manifold 1 may be mounted to a three-cylindered engine. Further, the intake manifold 1 may be mounted to a six-cylindered or eight-cylindered V-type engine.

The intake manifold 1 is produced by welding the four pieces 15. Alternatively, the intake manifold 1 may be produced by welding three or less than three pieces 15. Alternatively, the intake manifold 1 may be produced by welding five or more than five pieces 15.

The first piece 15*a* has the upstream side connector 7. The second piece 15*b* has the PCV connector 11. The third piece 15*c* has the EGR connector 10. Alternatively, the upstream side connector 7, the PCV connector 11, or the EGR connector 10 may be arranged in any piece 15.

Such changes and modifications are to be understood as being within the scope of the present invention as defined by the appended claims.

What is claimed is:

1. An intake manifold to be mounted to a traverse engine in which cylinders of the engine are arranged in a width direction of an automobile, the intake manifold comprising:

a plurality of pieces, which is made of resin and welded to each other so as to be traversely long in the width direction, wherein the plurality of pieces includes a first piece having a connector to be connected to the engine, and a second piece welded to the first piece, the second piece is welded to the connector of the first piece, the second piece has an upper positioning part, which overlaps with the first piece except for the connector from an upper side, so as to be welded to the first piece, the connector has a linear-shaped outlet passage, the upper positioning part is welded to the first piece so as to define an upstream side passage of the outlet passage, and the first piece has a cover, which covers the upper positioning part defining a downstream end of the upstream side passage from an upper side.

2. The intake manifold according to claim 1, wherein the first piece and the second piece are welded to each other through a welded part.

3. The intake manifold according to claim 2, wherein the cover prevents the second piece from moving upward, when the first and second pieces are separated from each other due to a breaking of the welded part.

4. An intake manifold to be mounted to a traverse engine in which cylinders of the engine are arranged in a width direction of an automobile, the intake manifold comprising:

a first piece having a connector defining a linear-shaped outlet passage, which is to be connected to the engine; and a second piece having an upper positioning part, which overlaps with the first piece except for the connector from an upper side, wherein the upper positioning part of the second piece is welded to the first piece, so as to define an upstream side passage of the outlet passage, and the first piece has a cover covering the upper positioning part from an upper side, such that the covered upper positioning part defines a downstream end of the upstream side passage of the outlet passage.

* * * * *